US006062488A

United States Patent [19]

McCafferty

[11] Patent Number: 6,062,488

[45] Date of Patent: May 16, 2000

[54] NOVELTY DRINKING STRAW PROVIDING CONTINUOUS STRAW ILLUSION

[76] Inventor: James R. McCafferty, 3885 S. Main St., Santa Ana, Calif. 92707

[21] Appl. No.: 09/276,008

[22] Filed: Mar. 25, 1999

[51] Int. Cl.[7] ..... A47G 21/18

[52] U.S. Cl. ..... 239/33; 446/200; 446/267; D7/300.2

[58] Field of Search ..... 239/24, 33, 289; 215/229, 388, 389; 220/705, 707, 709; D7/300.2; 446/267, 176, 200

[56] References Cited

U.S. PATENT DOCUMENTS

| | | | |
|---|---|---|---|
| D. 182,721 | 5/1958 | Howes | D7/300.2 |
| 2,619,770 | 12/1952 | Dinhofer | 446/200 |
| 3,260,462 | 7/1966 | Smaczny | 239/33 |
| 4,775,060 | 10/1988 | Pinney . | |
| 5,160,087 | 11/1992 | Mandell | 239/33 |
| 5,361,987 | 11/1994 | Matheussen et al. . | |
| 5,427,315 | 6/1995 | Lipson . | |
| 5,584,434 | 12/1996 | Lipson . | |

*Primary Examiner*—Andres Kashnikow
*Assistant Examiner*—Lisa Ann Douglas
*Attorney, Agent, or Firm*—Bever, Hoffman & Harms, LLP; Patrick T. Bever

[57] ABSTRACT

A novelty drinking straw including an elongated straw portion extending into a molded structure for passing liquid through the molded structure. A short straw portion is also attached to the molded structure and is aligned with the elongated straw portion to generate an illusion that the short straw portion and the elongated straw portion form a continuous liquid passage. The molded structure is in the form of an action figure or other character. The elongated straw portion and the short straw portion extend from opposing sides of a first hand of the action figure, thereby generating an illusion that the first hand is holding a single continuous straw. The elongated straw portion extends through a body of the action figure to a second elongated straw portion extending from a second hand. A second short straw portion is also attached to the second hand such that another illusion is generated that the second hand is holding a second continuous straw. In other embodiments, one or more mirrors are used to reflect semi-cylindrical sections extending inside a hollow structure to provide the illusion that two separated straw sections extend into the hollow structure.

6 Claims, 6 Drawing Sheets

NOVELTY DRINKING STRAW PROVIDING CONTINUOUS STRAW ILLUSION

FIELD OF THE INVENTION

The present invention relates to novelty drinking straws. More specifically, the present invention relates to novelty straw structures including objects attached to a straw.

RELATED ART

Novelty drinking straws are popular, in part, because they are inexpensive to manufacture and easy to package, thereby being desirable products to serve as a "premium" given away at such establishments as fast food restaurants, or to serve as favors at children's parties. Many of these novelty drinking straws include drinking passages which are in the form of loops, spirals, flowers, stick figures, eyeglasses, etc.

U.S. Pat. No. 5,584,434 discloses a drinking straw for use in combination with a prize object, such as a small ball or a two-part hollow plastic egg. The disclosed drinking straw includes a drinking tube defining a three dimensional cage including an interior volume for containing the prize object which is dimensioned to fit inside the cage. This patent discloses the need for novelty drinking straws that may be used in combination with toys and other amusement devices so as to create an item of great appeal to children. Such drinking straws may be used as promotional items, provided they are inexpensive and easy to manufacture.

SUMMARY

In accordance with a first embodiment of the present invention, a novelty drinking straw is provided in which an elongated straw portion and a short straw portion extend from opposing sides of a molded structure, such as the top and bottom of a hand connected to a toy action figure. The elongated straw portion communicates with a liquid passage that is bent at a sharp angle within and extends through the molded structure. The short straw portion is aligned with the elongated straw portion to generate the amusing illusion that a continuous drinking straw extends through the molded structure.

In accordance with a second embodiment of the present invention, the novelty drinking straw further includes a second elongated straw portion and a second short straw portion extending from opposite sides of the molded structure. The liquid passage extends from the first elongated straw portion to the second elongated straw portion. The second short straw portion extends from the molded structure in alignment with the third straw portion such that an additional amusing illusion is provided that the second elongated straw portion and the second short straw portion form a second continuous drinking straw.

In accordance with a third embodiment of the present invention an intermediate straw portion extends through a hollow portion of the molded structure between the first and second elongated straw portions. A first elbow section is located between the first elongated straw portion and the intermediate straw portion, and a second elbow section located between the second elongated straw portion and the intermediate straw portion. That is, the first elongated straw portion, first elbow, intermediate straw portion, second elbow and second elongated straw portion form a continuous drinking straw. The elbow sections facilitate the amusing illusions because they are hidden within the molded structure and redirect the liquid passage away from the axes of the elongated and short straw portions.

In accordance with a fourth embodiment of the present invention, the molded structure is formed as an action figure or other toy character having a body, a first arm with a first hand, and a second arm with a second hand. The first elongated straw portion extends upward to a lower surface of the first hand and the first short straw portion extends from an upper surface thereof, thereby providing an amusing illusion of a straw held by the first hand. Similarly, the second elongated straw portion extends upward from the second hand, and the second shorted straw portion extends downward from the second hand. The intermediate straw portion extends along the arms and through the body of the action figure and is hidden from view. When utilized as a drinking straw, suction applied to the second elongated straw portion causes liquid to pass up the first elongated straw portion and through the action figure to the second elongated straw portion.

In accordance with a fifth embodiment of the present invention, a novelty drinking straw is provided that includes a hollow structure, a straw extending through the hollow structure, a dual-pane mirror mounted in the hollow structure in front of a portion of the straw, and first and second short semi-cylindrical portions mounted in front of one section of the dual-pane mirror. An action figure is also located in the hollow structure in front of an intersection between the two sections of the mirror. In accordance with the fifth embodiment, the mirror obscures the central portion of the straw, thereby creating an illusion that the straw is discontinuous. The illusion is further enhanced by the semi-cylindrical portions, which are aligned with the straw and reflected by the mirror to form an illusion of two separated straw segments extending into the hollow structure.

In accordance with a sixth embodiment of the present invention, a novelty drinking straw is provided that includes a hollow structure, a straw extending through the hollow structure, a single-pane mirror mounted in the hollow structure in front of a portion of the straw, and first and second short semi-cylindrical portions mounted in front of the mirror. Similar to the fifth embodiment (discussed above), the single-pane mirror obscures a central portion of the straw, and the semi-cylindrical portions are aligned with the straw and reflected by the mirror to form the illusion of two separated straw segments extending into hollow structure 510. In addition, a pattern is formed on an inside surface of one side wall that is reflected by the mirror to enhance the illusion that causes a person looking through the front opening of the hollow structure to believe he/she is viewing the inside surface of a back wall 515. A benefit of using a single-pane mirror in place of the dual-pane mirror is that assembly costs are reduced, and the need for an action figure or other similar structure is eliminated.

The present invention will be more fully understood in view of the following description and drawings.

DETAILED DESCRIPTION

Figure 1A:
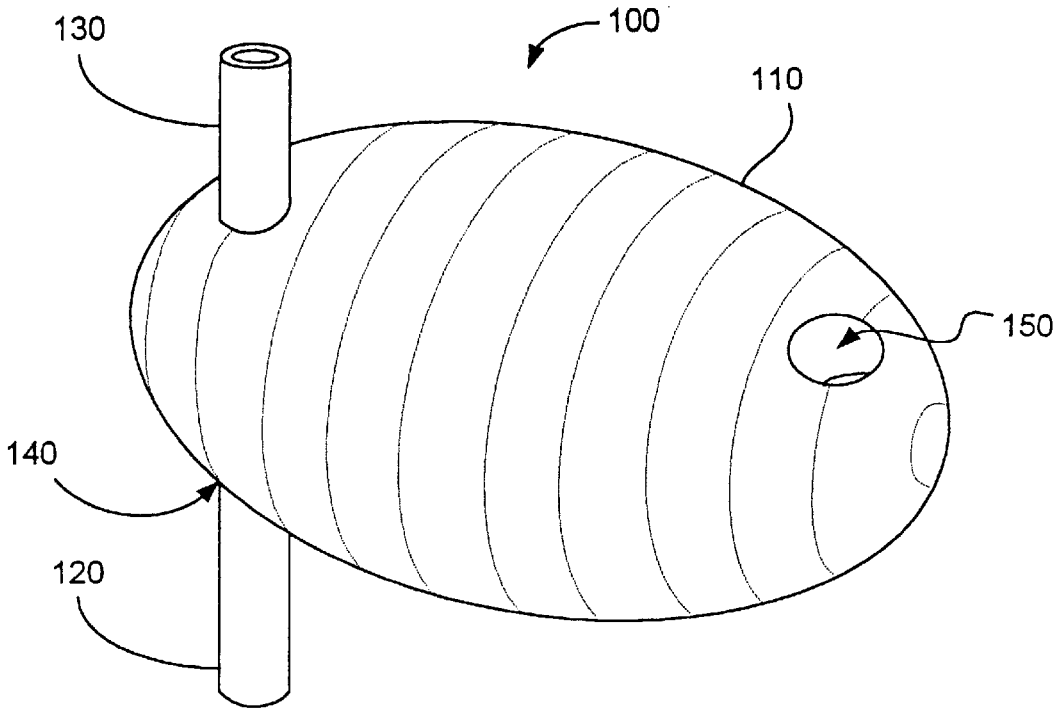
FIGS. 1(A) and 1(B) are perspective and cross-sectional elevation views showing a novelty drinking straw in accordance with a first embodiment of the present invention.
Figure 1B:
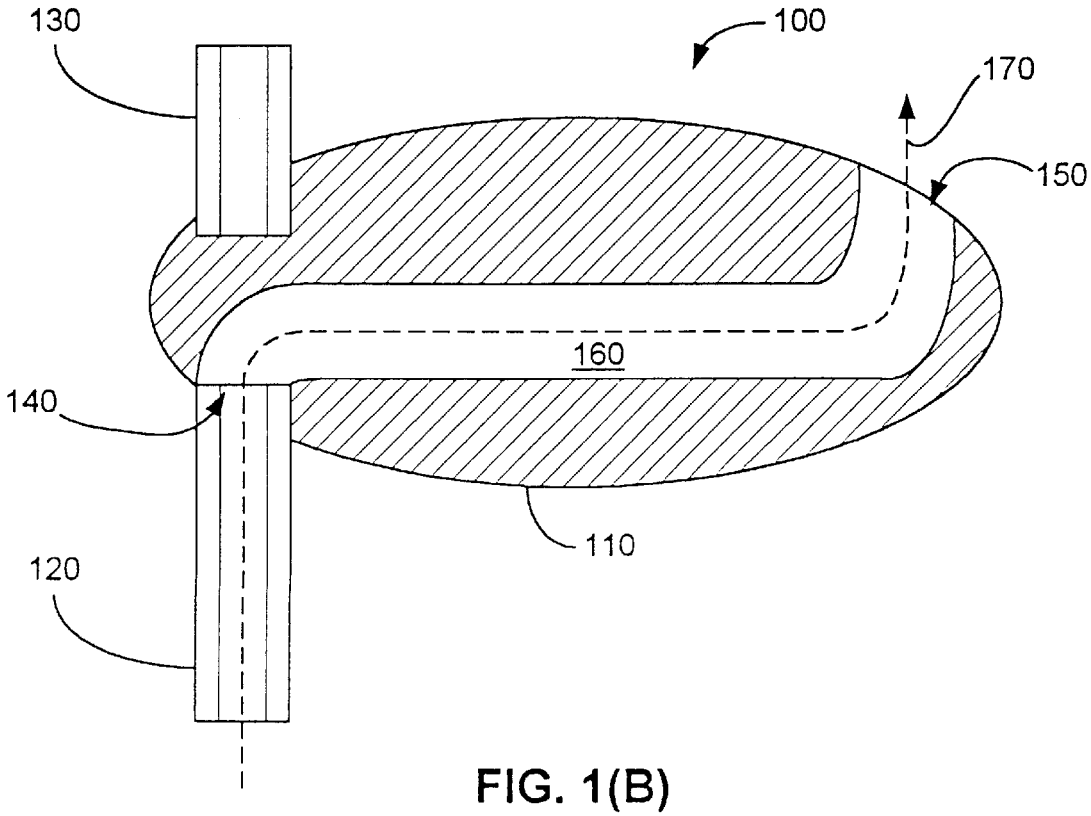

FIGS. 1(A) and 1(B) are perspective and cross-sectional views, respectively, of a novelty drinking straw 100 produced in accordance with a first embodiment of the present invention. Novelty drinking straw 100 includes a molded (e.g., plastic) structure 110, an elongated (first) straw portion 120 extending from a first opening 140 formed through a lower surface of molded structure 110, and a short (second) straw portion 130 extending from an upper surface of molded structure 110. Molded structure 110 is provided with a hollow portion 160 extending between first opening 140 and a second opening 150. Elongated straw portion 120 communicates with hollow portion 160 through first opening 140 such that a liquid passage (conduit) 170 is provided through elongated straw portion 120 and hollow portion 160 to second opening 150.

In accordance with the first embodiment, short straw portion 130 extends from molded structure 110 and is aligned with elongated straw portion 120 such that an amusing illusion is generated that elongated straw portion 120 and short straw portion 130 form a continuous liquid passage. In fact, the end of short straw portion 130 closest to molded structure 110 is sealed or otherwise blocked (i.e., short straw portion 130 is not part of a liquid passage).

Elongated straw portion 120 and short straw portion 130 are fabricated from a resilient plastic or rubber material, such as polyethylene tubing, and are connected to molded structure 110 using, for example, a suitable adhesive or fastening structure. In another embodiment, short straw portion 130 is integrally molded to a base that is received inside molded structure 110, and is formed from a second material that is similar in color and transparency to that of elongated straw portion 120.

Molded structure 110 is represented by an arbitrarily selected ovoid body in FIGS. 1(A) and 1(B). In practical embodiments, molded structure 110 is preferably formed as an action figure or other toy structure or shaped object to enhance amusement. Molded structure 110 is formed using an opaque plastic or other opaque material to facilitate the continuous straw illusion by obscuring the liquid passage through molded structure 110.

Figure 2:
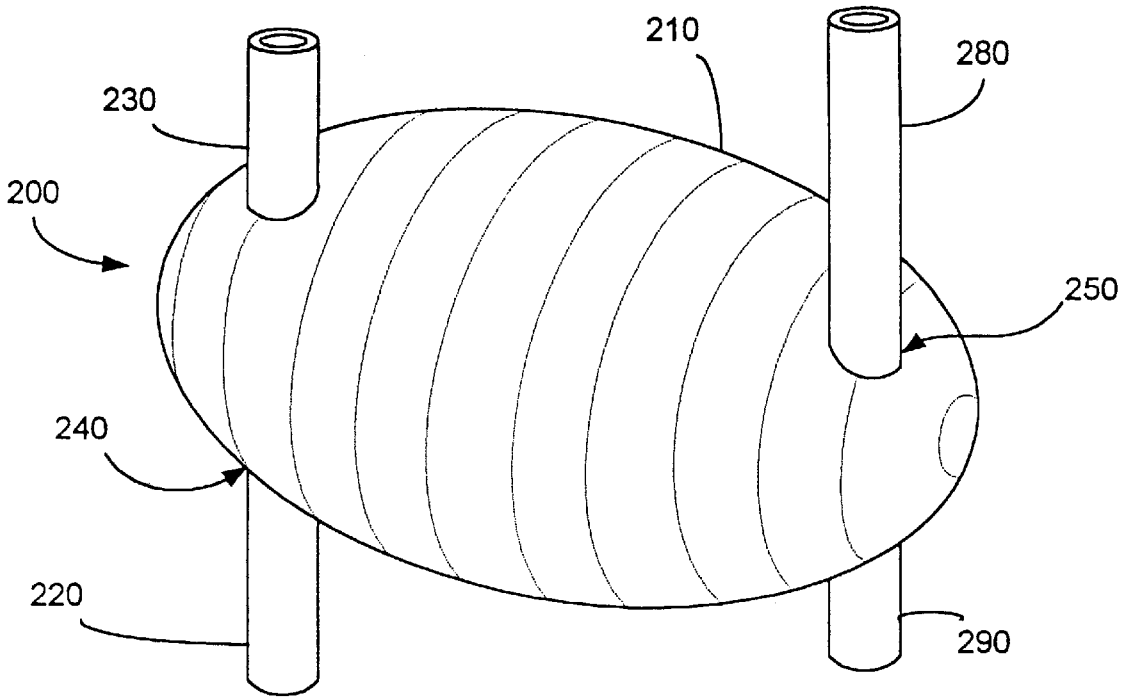
FIG. 2 is a perspective view showing a second novelty drinking straw in accordance with the present invention.

FIG. 2 is a perspective view showing a second novelty drinking straw 200. Novelty drinking straw 200 is similar to novelty drinking straw 100 (discussed above) in that it includes a first elongated straw portion 220 and a first short straw portion 230 that extend from opposing surfaces of a molded structure 210. However, novelty drinking straw 200 also includes a second elongated straw portion 280 and a second short straw portion 290 that extend from opposing surfaces of molded structure 210. Similar to first short straw portion 230, second short straw portion 290 is aligned with second elongated straw portion 280 to generate an additional amusing illusion that second short straw portion 290 and second elongated straw portion 280 form a second continuous drinking straw. Contrary to this illusion, second elongated straw portion 280 communicates with first elongated straw portion 220 to form a continuous liquid passage that extends through molded structure 210. This liquid passage is abruptly redirected from the direction of first elongated straw portion 220 and first short straw portion 230, and is subsequently redirected to the direction of second elongated straw portion 280 and second short straw portion 290, thereby providing an amusing illusion that liquid "magically" disappears from a first straw and reappears in an apparently unassociated second straw.

Figure 3A:
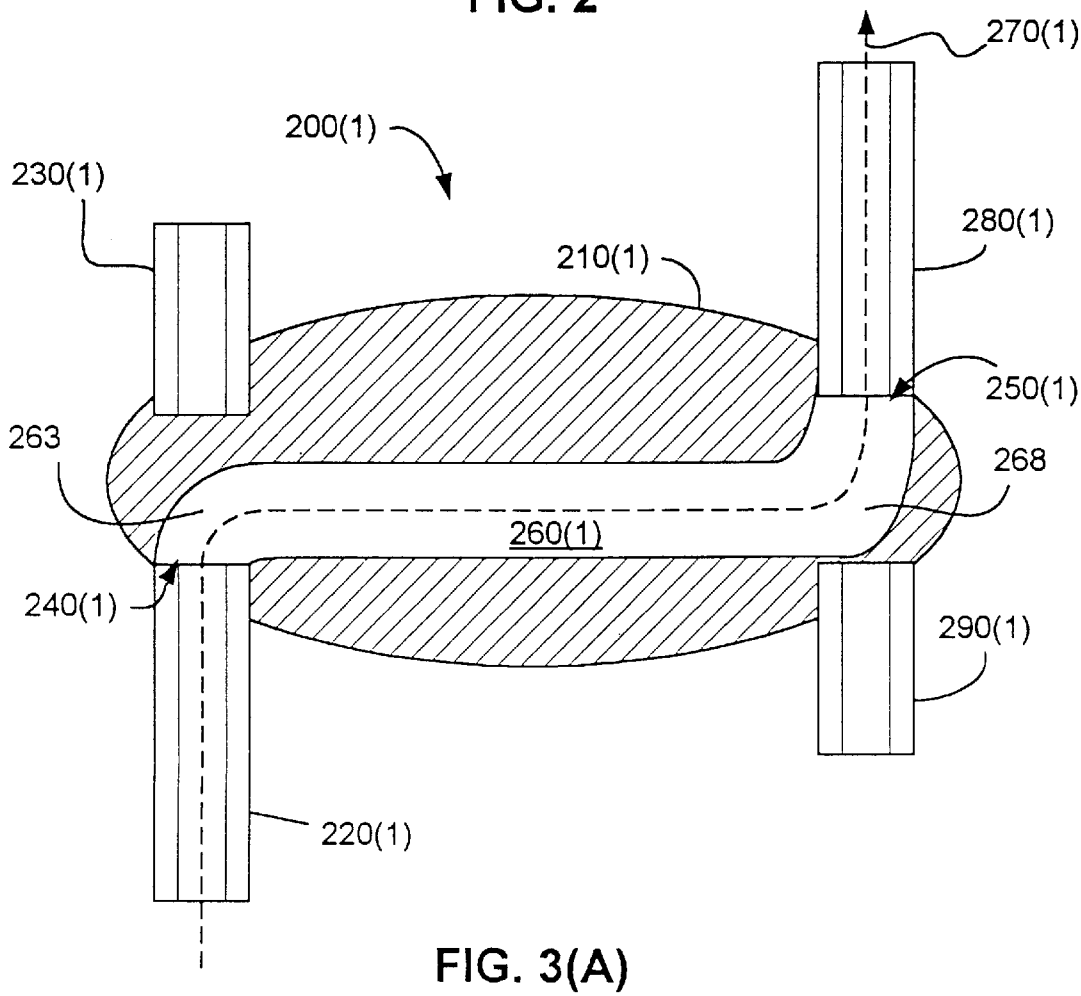
FIGS. 3(A) and 3(B) are cross-sectional elevation views showing novelty drinking straws in accordance with second and third embodiments of the present invention.
Figure 3B:
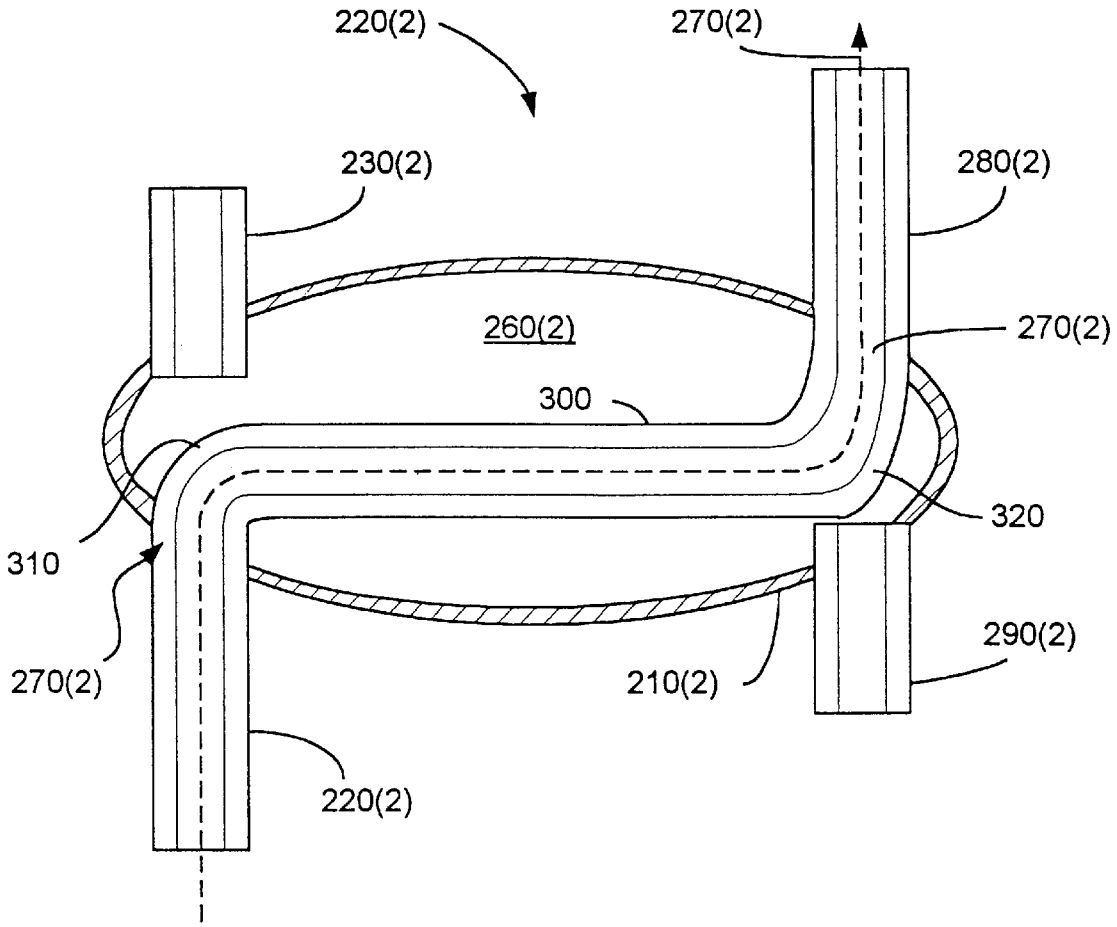

FIGS. 3(A) and 3(B) show novelty drinking straws in accordance with second and third embodiments of the present invention. Each of the second and third embodiments includes the exterior features of novelty drinking straw 200 (see FIG. 2). However, as disclosed below, the interior portions of novelty drinking straws associated with the second and third embodiments are different.

FIG. 3(A) is a cross-sectional view showing a novelty drinking straw 200(1) in accordance with the second embodiment of the present invention. Novelty drinking straw 200(1) includes a molded structure 210(1) that is essentially solid except for a tunnel (hollow portion) 260(1) that extends between a first opening 240(1) and a second opening 250(1). First elongated straw portion 220(1) is attached to molded structure 210(1) such that it communicates with first opening 240(1) and is aligned with first short straw portion 230(1). Similarly, second elongated straw portion 280(1) is attached to molded structure 210(1) such that it communicates with second opening 250(1) and is aligned with second short straw portion 290(1). Tunnel 260(1) includes a first bend (elbow) 263 that redirects liquid passing from first elongated straw portion 220(1) at a first angle of approximately 90° relative to the axial direction of first elongated straw portion 220(1). The liquid redirected by first bend 263 passes through molded structure 210(1) to a second bend (elbow) 268 that redirects the liquid at a second angle of approximately 90° such that the liquid is directed along the axial direction of second elongated straw portion 280(1).

FIG. 3(B) is a cross-sectional view showing a novelty drinking straw 200(2) in accordance with the third embodiment of the present invention. Novelty drinking straw 200(2) includes a molded structure 210(2) formed as a hollow shell defining a cavity (hollow portion) 260(2). An intermediate straw portion 300 that extends through cavity 260(2) connects first elongated straw portion 220(2) and second elongated straw portion 280(2). Specifically, first elongated straw portion 220(2) extends through first opening 240(2) and is aligned with first short straw portion 230(2). Similarly, second elongated straw portion 280(2) extends through second opening 250(2) and is aligned with second short straw portion 290(2). Intermediate straw portion 300 includes a first elbow portion 310 that redirects liquid passing from first elongated straw portion 220(2) at a first angle of approximately 90° relative to the axial direction of first elongated straw portion 220(2). The liquid redirected by first elbow portion 310 passes through a straight section of intermediate straw portion 300 to a second elbow portion 320. Second elbow portion 320 again redirects the liquid at a second angle of approximately 90° such that the liquid is directed along the axial direction of second elongated straw portion 280(2). According to the third embodiment, first elongated straw portion 220(2), first elbow portion 310, intermediate straw portion 300, second elbow portion 320 and second elongated straw portion 290(2) form a continuous drinking straw. First and second elbow portions 310 and 320 facilitate the amusing illusions because they are hidden within molded structure 210(2) and redirect the liquid passage away from the axes of first and second elongated straw portions 220(2) and 280(2).

Figure 4A:
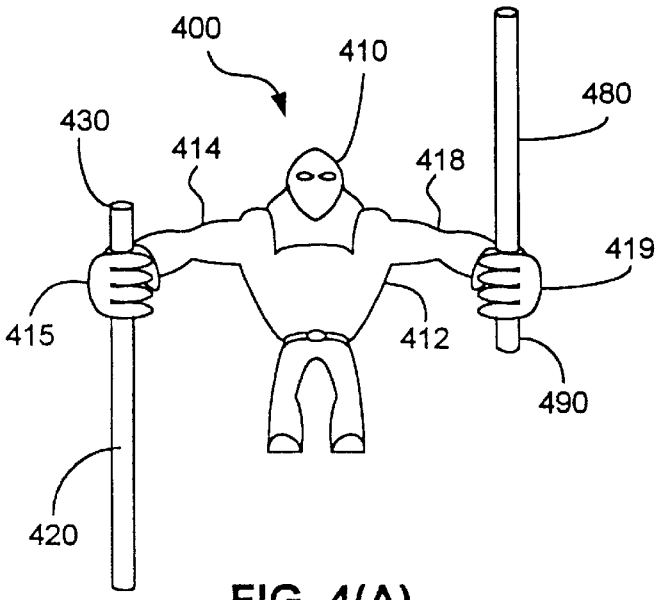
FIG. 4(A) is a front elevation view showing a novelty straw in accordance with a fourth embodiment of the present invention.
Figure 4B:
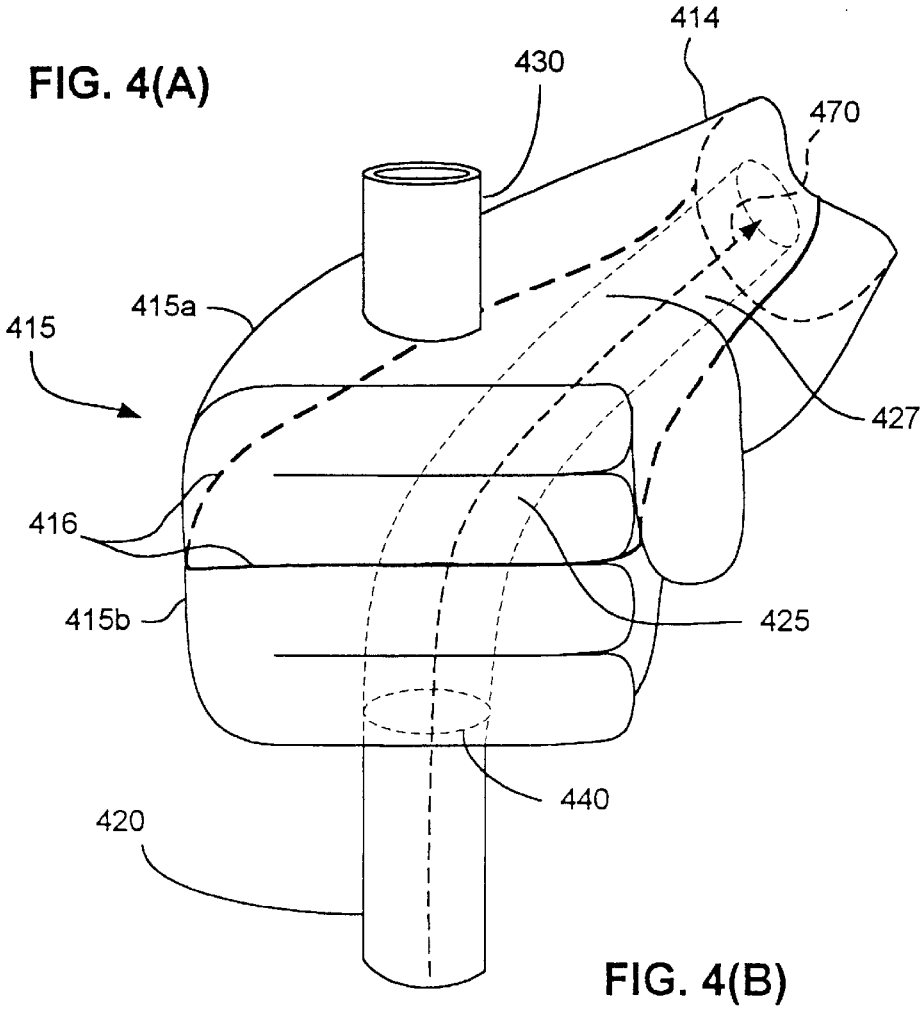
FIG. 4(B) is a perspective view showing a portion of the novelty straw in accordance with the fourth embodiment.

FIG. 4(A) is a front elevation view showing a novelty drinking straw 400 in accordance with a fourth embodiment of the present invention. Novelty drinking straw 400 includes a molded structure 410 that is formed and colored to depict a selected action figure, cartoon character or other amusing toy creature. Molded structure 410 includes a body 412, a first arm 414 with a first hand 415, and a second arm 418 with a second hand 419. A first elongated straw portion 420 extends upward to a lower surface of first hand 415 and a first short straw portion 430 extends from an upper surface of first hand 415, thereby providing an amusing illusion that a continuous straw is grasped by first hand 415. Similarly, a second elongated straw portion 480 extends upward from second hand 419, and a second shorted straw portion 490 extends downward from second hand 419. An intermediate straw portion (a portion of which is shown in FIG. 4(B)) extends from first hand 415, along first arm 414, through body 412, into second arm 418 and to second hand 419. This intermediate straw portion is concealed within molded structure 410 to provide an amusing illusion of a figure holding two separate straws.

FIG. 4(B) is an enlarged perspective view showing first hand 415 and a portion of first arm 414. First hand 415 is divided by a mold line 416 into an upper section 415*a* and a lower section 415*b* that are connected by, for example, a suitable adhesive. Short straw portion 430 is mounted to upper section 415*a*. Elongated straw portion 420 extends through opening 440 in a direction substantially aligned with an axis of short straw portion 430. An elbow portion 425 communicates with elongated straw portion 420 and redirects liquid passing along passage 470 to a relatively straight straw portion 427 extending up first arm 414.

Figure 5A:
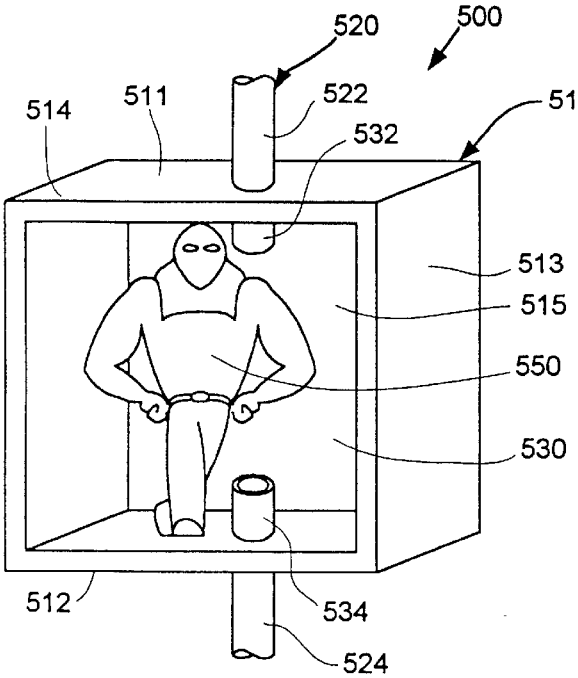
FIG. 5(A) is a front perspective view showing a novelty straw in accordance with a fifth embodiment of the present invention.
Figure 5B:
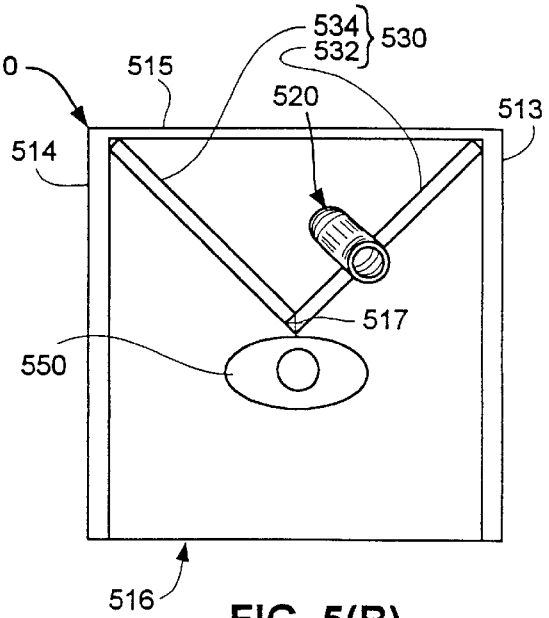
FIG. 5(B) is a top view showing the novelty straw of the fifth embodiment with an upper wall removed.
Figure 5C:
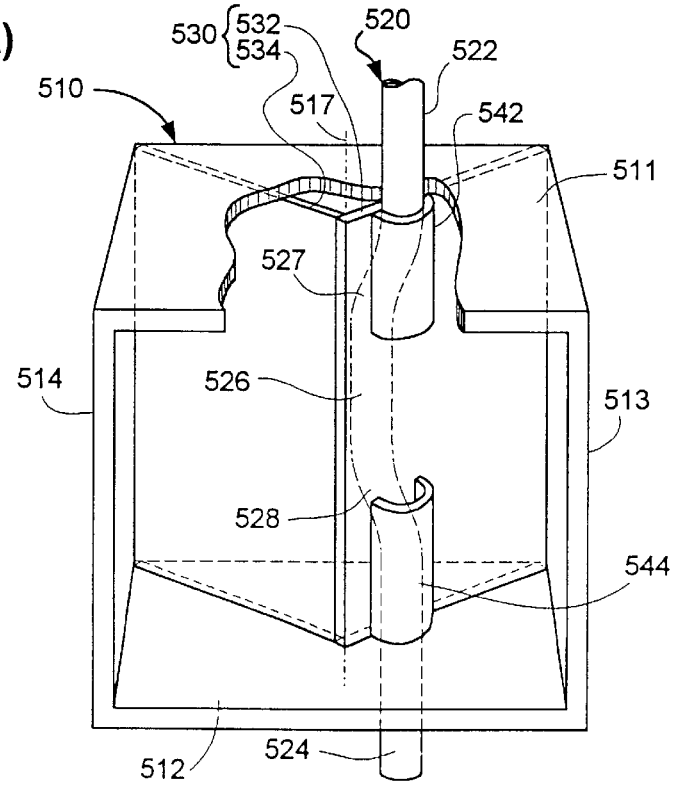
FIG. 5(C) is a cut-away perspective view showing the novelty straw of the fifth embodiment with an action figure removed.

FIGS. 5(A) through 5(C) are perspective, top and cutaway partial perspective views, respectively, of a novelty drinking straw 500 produced in accordance with a fifth embodiment of the present invention.

As indicated in FIG. 5(A), novelty drinking straw 500 includes a hollow (e.g., plastic) structure 510 having an open side, a straw 520 extending through hollow structure 510, a mirror 530 mounted in hollow structure 510 between straw 520 and the open side, and first and second short semi-cylindrical portions 542 and 544 mounted between mirror 530 and the open side. An action figure (or other structure) 550 is also located in hollow structure 510 in front of mirror 530. Semi-cylindrical portions 542 and 544 are aligned with straw 520 and reflected by mirror 530, which also reflect inside surfaces of hollow structure 510. In accordance with the fifth embodiment, these reflections create an illusion that straw 520 is separated into two (upper and lower) straw segments that respectively extend into upper and lower walls of hollow structure 510. Therefore, when liquid is sucked through straw 520, an amusing illusion is created that liquid "magically" travels across the gap from the lower straw segment to the upper second straw segment.

As indicated by FIGS. 5(A) through 5(C), hollow structure 510 is in the form of a box having an upper wall 511, a lower wall 512, a first side wall 513, a second side wall 514, a back wall 515 and a front opening 516. A central axis 517 extends between upper wall 511 and lower wall 512. Although hollow structure 510 is shown as a box, other shapes may also be used.

Referring to FIG. 5(C), straw 520 is a continuous structure including a first portion 522 extending through a (first) opening formed in upper wall 511, a second portion 524 extending through a (second) opening formed in lower wall 512, and a third portion 526 extending between first portion 522 and second portion 524 within hollow structure 510. Third portion 526 includes a first bent section 527 located directly below the opening in upper wall 511, and a second bent section 528 located directly above the opening in lower wall 512. Third portion 526 is located between mirror 530 and back wall 515. Semi-cylindrical portion 542 extends downward from upper wall 511 immediately in front of mirror 530, thereby hiding first bent section 527. Similarly, semi-cylindrical portion 544 extends downward from upper wall 512 to hide second bent section 528. First and second bent sections 527 and 528 are provided to allow close alignment between an axis of the first and second straw portions 522 and 524 and an axis of semi-cylindrical portions 542 and 544. By aligning these axes, the illusion that semi-cylindrical portions 542 and 544 respectively extend from first straw portion 522 and second straw portion 524 is enhanced. If necessary, mirror 530 may be provided with notches (not shown), through which bent sections 527 pass. These notches are hidden from a person looking through front opening 516 by semi-cylindrical portions 542 and 544.

As shown in FIGS. 5(B) and 5(C), mirror 530 includes a first mirror section 532 and a second mirror section 534 having inner edges that meet at an approximately 90° angle at central axis 517. The angle at which first mirror section 532 and second mirror section 534 meet is selected such that mirror sections 532 and 534 reflect the inside surfaces of first side wall 513 and second side wall 514. The resulting illusion causes a person looking through front opening 516 to believe he/she is viewing the inside surface of back wall 515 (as illustrated in FIG. 5(A)). As shown in FIG. 5(B), action FIG. 550 is positioned between central axis 517 and front opening 516 such that the edges of first mirror section 532 and second mirror section 534 are obscured, thereby enhancing the amusing illusion.

Figure 6A:
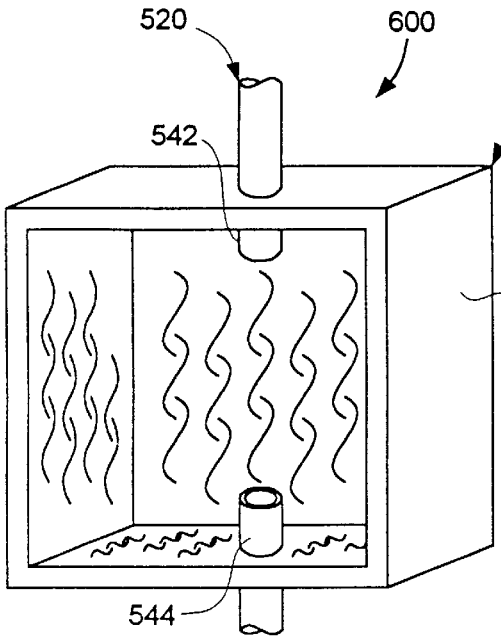
FIG. 6(A) is a front perspective view showing a novelty straw in accordance with a sixth embodiment of the present invention.
Figure 6B:
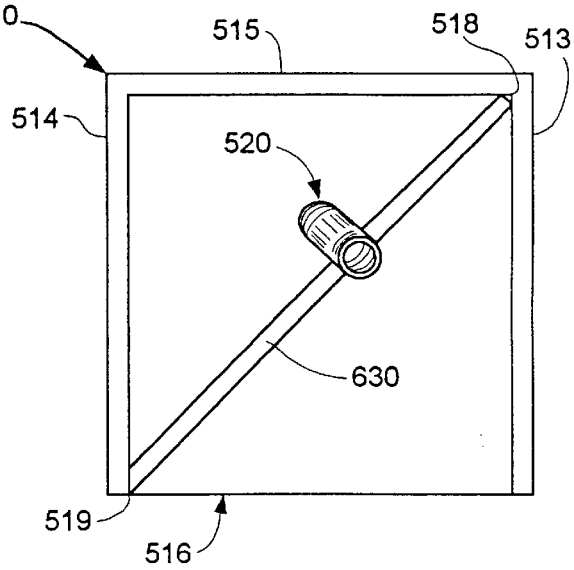
FIG. 6(B) is a top view showing the novelty straw of the sixth embodiment with an upper wall removed.
Figure 6C:
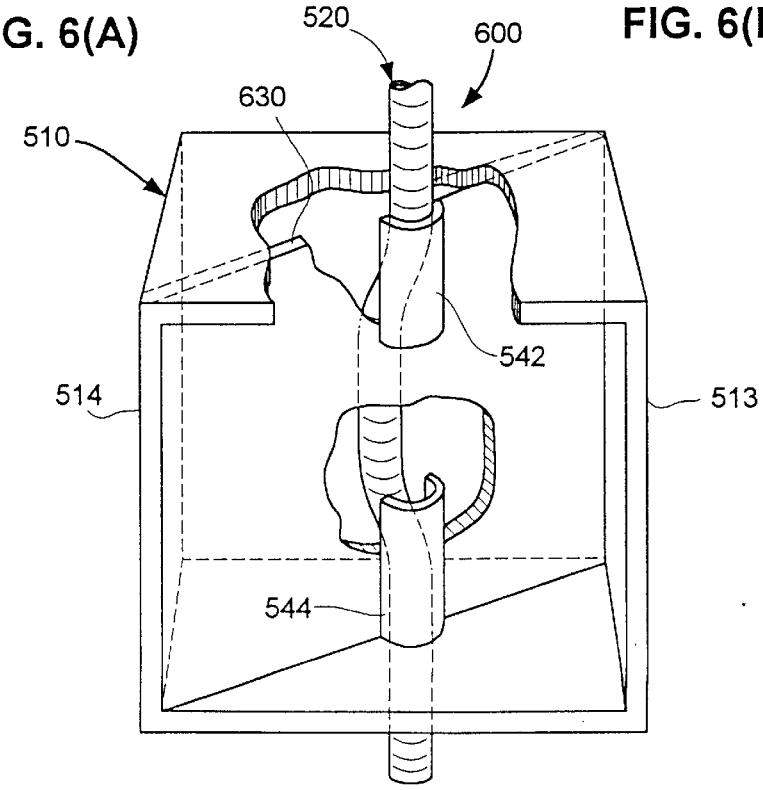
FIG. 6(C) is a cut-away perspective view showing the novelty straw of the sixth embodiment.

FIGS. 6(A) through 6(C) are perspective, top and cutaway partial perspective views, respectively, of a novelty drinking straw 600 produced in accordance with a sixth embodiment of the present invention. Portions of novelty drinking straw 600 that are essentially identical to those used in the fifth embodiment (discussed above) are identified with like reference numbers.

As indicated in FIG. 6(A), novelty drinking straw 600 includes hollow (e.g., plastic) structure 510, straw 520 extending through hollow structure 510, a mirror 630 mounted in hollow structure 510 and located in front of straw 520, first and second short semi-cylindrical portions 542 and 544 mounted in front of mirror 630. Similar to the fifth embodiment (discussed above), mirror 630 obscures a central portion of straw 520, and semi-cylindrical portions 542 and 544 are aligned with straw 520 and reflected by mirror 630 to create an illusion of two separated straw segments extending into hollow structure 510. However, novelty drinking straw 600 differs from the fifth embodiment in that mirror 630 includes a single pane that extends at an approximately 45° angle from an intersection 518 of first side wall 513 and back wall 515, and an intersection 519 of second side wall 512 and front opening 516. In addition, a pattern is formed on an inside surface of first side wall 513 that is reflected by mirror 630 to enhance the illusion that causes a person looking through front opening 516 to believe he/she is viewing the inside surface of back wall 515 (as indicated in FIG. 6(A)). A benefit of using single-pane mirror 630 in place of dual-pane mirror 530 (described above) is that assembly costs are reduced, and the need for action FIG. 550 (shown in FIG. 5(A)) is eliminated.

Although the invention has been described in connection with several embodiments, it is understood that this invention is not limited to the embodiments disclosed, but is capable of various modifications which would be apparent to a person skilled in the art. For example, the short straw portions used in the first embodiment can be formed as a single continuous straw that loops around the molded structure. Thus, the invention is limited only by the following claims.

What is claimed is:

1. A novelty drinking straw comprising:

a molded structure defining a first opening and a second opening;

a first straw portion extending from the first opening of the molded structure; and a second straw portion extending from the molded structure;

wherein the molded structure includes a hollow portion extending between the first opening and the second opening, whereby a liquid passage is provided from the first straw portion through the hollow portion to the second opening, and wherein the second straw portion extends from the molded structure in alignment with the first straw portion such that an illusion is provided that the first straw portion and the second straw portion form a continuous straw structure.

2. The novelty drinking straw according to claim 1, further comprising:

a third straw portion extending from the second opening of the molded structure; and a fourth straw portion extending from the molded structure;

wherein the liquid passage extends from the first straw portion to the third straw portion, and wherein the fourth straw portion extends from the molded structure in alignment with the third straw portion such that an illusion is generated that the third straw portion and the fourth straw portion form a second continuous straw structure.

3. The novelty drinking straw according to claim 2, further comprising a fifth straw portion connected between the first straw portion and the third straw portion, the fifth straw portion extending through the hollow portion between the first opening and the second opening of the molded structure.

4. The novelty drinking straw according to claim 3, further comprising a first elbow portion located between the first straw portion and the fifth straw portion, and a second elbow portion located between the third straw portion and the fifth straw portion.

5. The novelty drinking straw according to claim 3, wherein the molded structure is formed as an action figure having a first arm having a first hand defining the first opening, and a second arm having a second hand defining the second opening, and wherein the fifth straw portion extends from the first opening in the first hand to the second opening formed in the second hand.

6. The novelty drinking straw according to claim 5, wherein the first opening is formed in a lower region of the first hand, wherein the first straw portion extends through the first opening and communicates with the fifth straw portion via an elbow portion, and wherein the second straw portion extends from an upper region of the first hand.

* * * * *